US008692727B2

(12) United States Patent
Mukai et al.

(10) Patent No.: US 8,692,727 B2
(45) Date of Patent: Apr. 8, 2014

(54) GLASS ANTENNA FOR VEHICLE

(75) Inventors: Hiroshi Mukai, Matsusaka (JP); Takayuki Suzuki, Taki-gun (JP)

(73) Assignee: Central Glass Company, Limited, Ube-shi (JP)

( * ) Notice: Subject to any disclaimer, the term of this patent is extended or adjusted under 35 U.S.C. 154(b) by 163 days.

(21) Appl. No.: 13/510,079

(22) PCT Filed: Oct. 26, 2010

(86) PCT No.: PCT/JP2010/068990
§ 371 (c)(1),
(2), (4) Date: May 16, 2012

(87) PCT Pub. No.: WO2011/058878
PCT Pub. Date: May 19, 2011

(65) Prior Publication Data

US 2012/0229353 A1 Sep. 13, 2012

(30) Foreign Application Priority Data

Nov. 16, 2009 (JP) ..... 2009-261134

(51) Int. Cl.
*H01Q 1/32* (2006.01)

(52) U.S. Cl.
USPC ..... 343/713

(58) Field of Classification Search
USPC ..... 343/713, 711
See application file for complete search history.

(56) References Cited

U.S. PATENT DOCUMENTS

| | | | | |
|---|---|---|---|---|
| 4,727,377 | A | 2/1988 | Yotsuya et al. | |
| 6,369,767 | B1 | 4/2002 | Oka et al. | |
| 6,822,613 | B2 * | 11/2004 | Kubota | 343/713 |

FOREIGN PATENT DOCUMENTS

| | | | | |
|---|---|---|---|---|
| JP | 61-265904 | A | 11/1986 | |
| JP | 61-197712 | U | 12/1986 | |
| JP | 1-117106 | U | 8/1989 | |
| JP | 7-46016 | A | 2/1995 | |
| JP | 9-284025 | * | 10/1997 | H01Q 1/32 |
| JP | 2000-151249 | * | 5/2000 | H01Q 1/32 |
| JP | 2001-136013 | A | 5/2001 | |
| JP | 2002-64317 | A | 2/2002 | |
| JP | 2002-100914 | A | 4/2002 | |

(Continued)

OTHER PUBLICATIONS

International Search Report with English translation dated Jan. 25, 2011 (five (5) pages).

(Continued)

*Primary Examiner* — Hoang V Nguyen
(74) *Attorney, Agent, or Firm* — Crowell & Moring LLP

(57) ABSTRACT

A glass antenna includes hot-side and earth-side feeding points provided near an intermediate portion of an inside vertical or vertically-oblique edge of flange of a fixed window glass; a hot-side element; and an earth-side element. The hot-side element includes at least one first horizontal line extending from the hot-side feeding point in a horizontal direction, and at least one first vertical line extending from the hot-side feeding point in a direction away from the earth-side feeding point. The earth-side element includes at least one second horizontal line extending from the earth-side feeding point in the horizontal direction, and a third horizontal line extending from a tip of at least one second vertical line in the horizontal direction. The at least one second vertical line extends from the earth-side feeding point in a direction away from the hot-side feeding point.

9 Claims, 8 Drawing Sheets

(56) References Cited

FOREIGN PATENT DOCUMENTS

| | | | | |
|---|---|---|---|---|
| JP | 2003-163523 | * | 6/2003 | ..... H01Q 1/32 |
| JP | 2004-88748 A | | 3/2004 | |
| JP | 2005-354139 A | | 12/2005 | |
| JP | 2009-49706 A | | 3/2009 | |

OTHER PUBLICATIONS

Form PCT/ISA/237 (three (3) pages).

* cited by examiner

GLASS ANTENNA FOR VEHICLE

TECHNICAL FIELD

The present invention relates to a glass antenna which is provided to a window glass of a vehicle and which is adapted to receive a broadcast wave for digital terrestrial television and a broadcast wave for analog television having UHF band, more particularly, relates to an ungrounded-type glass antenna which is provided to a non-opening fixed window glass of a side portion of a vehicle.

BACKGROUND OF THE INVENTION

Recently, the broadcast wave for television in Japan is being changed from an analog terrestrial broadcasting having a VHF band ranging from 90 to 220 MHz or a UHF band ranging from 470 to 770 MHz to a digital terrestrial broadcasting ranging from 470 to 710 MHz. A device for transmitting and receiving airwaves in a vehicle also needs to deal with the digital terrestrial broadcasting.

Previously, an antenna pattern has been constructed with a central focus on a horizontal element in many cases. In a case that such a antenna pattern is provided to a front window glass or a rear window glass of the vehicle, this antenna is apparently viewed as a dot or short-line shape by airwaves coming from a side direction (lateral side) of the vehicle. Hence, there has been a problem that a sufficient resonance cannot be obtained so that a receiving sensitivity for the airwaves coming from the side direction of the vehicle is low to cause an insufficient directivity.

As a countermeasure, if an antenna is mounted on a side window glass of the vehicle to complement the reception of the airwaves coming from the side direction by diversity reception, the directivity is improved to a satisfactory level. However, in this case, a place to which the antenna pattern is provided is limited to a non-opening window glass of the vehicle. Hence, in a type of vehicle to which the previous antenna pattern cannot be provided such as a vehicle type in which the side window does not include a non-opening window glass having an area sufficient to form the antenna pattern and a vehicle type in which the non-opening window is located in a part of a door, a plurality of antennas are provided to the front window glass and the rear window glass to perform the diversity reception. However, in this case, a satisfactory directivity is not obtained to the airwaves coming from the side direction of the vehicle.

Moreover, since the broadcast wave for television is nowadays being changed from the analog terrestrial broadcasting having the VHF band or the UHF band ranging from 470 to 770 MHz to the digital terrestrial broadcasting ranging from 470 to 710 MHz, the device for transmitting and receiving airwaves in a vehicle needs to deal with the digital terrestrial broadcasting. For the transmission and reception of the digital terrestrial broadcasting, an antenna having higher sensitivity than that for the transmission and reception of the analog terrestrial broadcasting is necessary, and an ungrounded-type antenna system needs to be employed. Since this ungrounded-type antenna system tends to occupy a large area as compared with a grounded-type antenna, it has been necessary to reduce the area of the ungrounded-type antenna.

Japanese Patent Application Publication No. 2005-354139 discloses one concrete example in which an antenna for receiving the digital broadcasting is provided to a window glass of vehicle. In this technique, a glass antenna apparatus for vehicle receives signals for digital television (maximum frequency: f1, its corresponding wavelength: $\lambda 1$, minimum frequency: f2, its corresponding wavelength: $\lambda 2$). This glass antenna includes two of an upper-side antenna element and a lower-side antenna element which are provided to the window glass of the vehicle to satisfy a positional relation in upper-lower direction with each other and both of which extend in the horizontal direction; and includes a phase synthesizer which retards one of reception signals derived from power feeding terminals of these two antenna elements by a phase of 190°~220° and which combines the retarded reception signal with another reception signal. (see Patent Literature 1)

Moreover, Japanese Patent Application Publication No. 2002-100914 discloses another technique of glass antenna for a vehicle. In this technique, a first antenna conductor, a second antenna conductor, a power-feeding point for the first antenna conductor and a power-feeding point for the second antenna conductor are provided to a window glass plate of the vehicle. The first antenna conductor intersects with the second antenna conductor. At this intersection portion, the first antenna conductor and the second antenna conductor are formed in a layered structure so as to sandwich an insulation layer therebetween. The first antenna conductor intersects with the second antenna conductor to form an intersection angle ranging from 60 degrees to 120 degrees. A length L1 of the first antenna conductor and a length L2 of the second antenna conductor satisfy a relation of $0.5 \cdot L2 \leq L1\ 2.0 \cdot L2$. (see Patent Literature 2)

Moreover, Japanese Patent Application Publication No. 7-46016 discloses an ungrounded-type window glass antenna for an automobile telephone. In this technique, a hot-side antenna line is provided to a window glass and extended in the horizontal direction so as to be electromagnetically coupled with an upper or lower horizontal edge of a metallic window frame of vehicle body to which the window glass is attached. On the other hand, an earth-side antenna line is located in an inner (central) portion of the window glass beyond the hot-side antenna line. One end of the earth-side antenna line is located near one end or a center of the hot-side antenna line. (see Patent Literature 3)

Furthermore, Japanese Patent Application Publication No. 2009-49706 discloses a glass antenna for a vehicle as an ungrounded-type antenna for digital terrestrial broadcasting. In this technique, the antenna for receiving a broadcast wave for the digital terrestrial television is provided to a corner portion of a window glass of a side portion of the vehicle that is located on a rear-seat side. This antenna includes two positive and negative (power-) feeding points provided to the corner portion of the side window glass, a first element, and a second element. The first element includes a first vertical line which extends vertically toward a corner and which is at least one of at least two lines extending from the positive feeding point, and a first horizontal line extending horizontally from a tip of the first vertical line or from an intermediate portion of the first vertical line in a branched manner. The second element includes at least two second horizontal lines extending horizontally from the negative feeding point, and a second vertical line extending vertically from the negative feeding point. The positive and negative feeding points are connected respectively with a core wire and an enveloping conductor wire of a coaxial cable. (see Patent Literature 4)

CITATION LIST

Patent Literature

Patent Literature 1: Japanese Patent Application Publication No. 2005-354139

Patent Literature 2: Japanese Patent Application Publication No. 2002-100914

Patent Literature 3: Japanese Patent Application Publication No. 7-46016

Patent Literature 4: Japanese Patent Application Publication No. 2009-49706

SUMMARY OF THE INVENTION

In the above Patent Literatures 1 and 2, the glass antennas provided to the front glass and the rear glass are operated to perform a diversity reception. The apparatus that retards a phase of the reception signal derived from one of the antennas and then combines the retarded signal with the reception signal derived from another of the antennas is used so that the directivity characteristic is controlled. Hence, in these techniques, the directivity characteristic is not improved by a structure of antenna itself. Moreover, these techniques do not relate to an antenna for receiving the broadcast wave of digital terrestrial television that is provided to the corner portion of the window glass located in the rear-seat-side portion of the side portion of the vehicle.

In the above Patent Literature 3, the diversity reception is performed by using the glass antenna devices provided respectively to the front glass and the rear glass. The directivity is controlled by using the apparatus for combining the phase-retarded reception signal of one antenna device with the reception signal of another antenna device. This glass antenna for an automobile telephone is not an antenna for receiving the broadcast wave of digital terrestrial television, and does not improve the directivity characteristic by virtue of the structure of antenna itself.

In the above Patent Literature 4, the antenna for receiving the broadcast wave of digital terrestrial television which is provided to the corner portion of the window glass which is located in the rear-seat-side portion of the side portion of the vehicle includes the positive feeding point and the negative feeding point located below the positive feeding point. Hence, in a case that a metallic mold has to be installed on a surrounding portion of whole the window glass of the side portion, the metallic mold is attached to a part of a non-opening window glass. This metallic mold is in an insulated state from the vehicle body in general cases. Therefore, if trying to provide the antenna of the Patent Literature 4 to the non-opening window having an small area in a rear quarter or the like, there is a problem that the antenna is adversely affected by the metallic mold because the hot-side element is located closer to an upper corner of the non-opening window than the earth-side element.

It is an object of the present invention to solve such a problem. That is, the object of the present invention is to provide an ungrounded-type antenna for digital terrestrial television within a narrow space of the non-opening fixed window glass plate of the side portion of vehicle so that an occupied area of the antenna is reduced while a high-sensitive and stable reception gain can be obtained to reduce a variability of the reception gain without degrading an antenna performance.

According to one aspect of the present invention, there is provided a glass antenna for a vehicle, the antenna being provided to a non-opening fixed window glass of a side portion of the vehicle and being configured to receive a broadcast wave for digital terrestrial television, the antenna comprising: hot-side and earth-side feeding points provided to satisfy a substantially up-down positional relation thereof near an intermediate portion of an inside vertical or vertically-oblique edge of a flange of the window glass; a hot-side element including at least one first horizontal line extending from the hot-side feeding point in a horizontal direction away from the vertical or vertically-oblique edge of the flange, and at least one first vertical line extending from the hot-side feeding point in a direction away from the earth-side feeding point and along the vertical or vertically-oblique edge of the flange; and an earth-side element including at least one second horizontal line extending from the earth-side feeding point in the horizontal direction away from the vertical or vertically-oblique edge of the flange, and a third horizontal line extending from a tip portion of at least one second vertical line in the horizontal direction away from the vertical or vertically-oblique edge of the flange, the at least one second vertical line extending from the earth-side feeding point in a direction away from the hot-side feeding point and along the flange, wherein the antenna is of ungrounded type in which the hot-side and earth-side feeding points are connected respectively to a core conductor and an enveloping conductor of a coaxial cable.

DETAILED DESCRIPTION OF INVENTION

According to the present invention, there is provided a glass antenna which can receive with a high performance a broadcast wave for digital terrestrial television that has a frequency ranging from 470 MHz to 710 MHz. This glass antenna is provided on an interior-side surface of a non-opening window glass (fixed-sash-type window) which constitutes a side window of a vehicle (automobile), by printing an electrically-conductive ceramic paste on a location near an intermediate portion of a vertically-extending edge (hereinafter, vertical edge) of the window glass.

Figure 1:
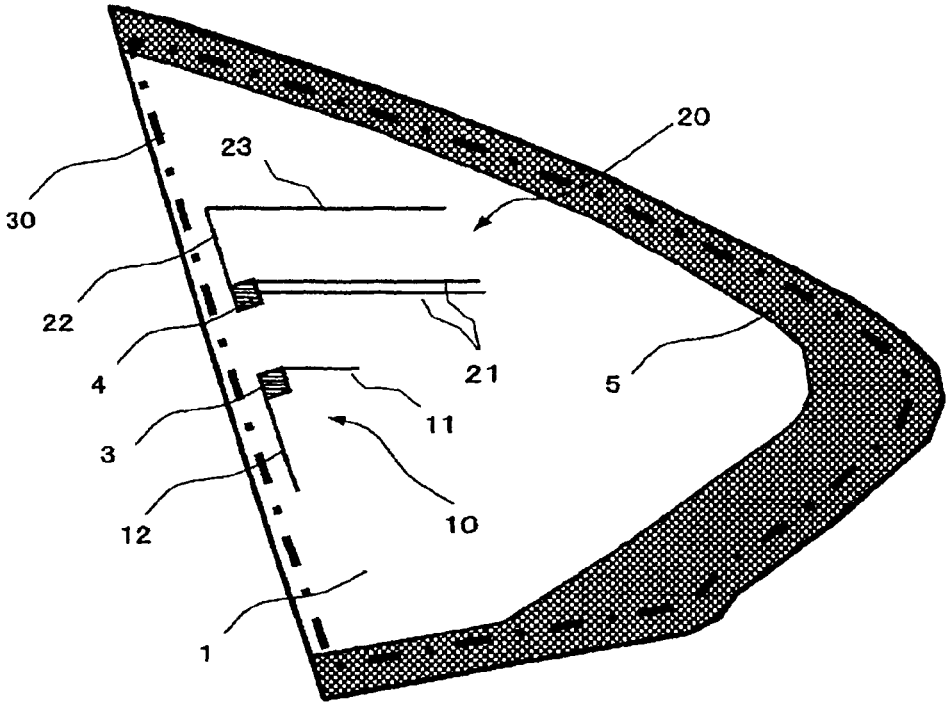
FIG. 1 A view showing a first example of glass antenna according to the present invention.

As shown in FIG. 1, the glass antenna is an ungrounded-type (floating) antenna including a hot-side feeding point 3, an earth-side feeding point 4, a hot-side element 10 and an earth-side element 20. The hot-side element 10 includes a line(s) extended from the hot-side feeding point 3. The earth-side element 20 includes a line(s) extended from the earth-side feeding point 4. The two power-feeding points of the hot-side feeding point 3 and the earth-side feeding point 4 are provided near an intermediate portion of an inside vertically-extending edge (hereinafter, vertical edge) of a flange of the non-opening window glass. The hot-side feeding point 3 and the earth-side feeding point 4 have a positional relation substantially in upper and lower directions with each other (with respect to a gravity direction). The hot-side feeding point 3 is connected to a core conductor 2*a* of a coaxial cable 2, and the earth-side feeding point 4 is connected to an enveloping conductor wire 2*b* of the coaxial cable 2.

A basic form according to the present invention is as shown in FIG. 1. That is, the hot-side element 10 is constituted by at least one first horizontal line 11 extending from the hot-side feeding point 3 in a horizontal direction away from the vertical edge of the flange 30, and at least one first vertical line 12 extending from the hot-side feeding point 3 in a direction away from the earth-side feeding point 4 and along the vertical or vertically-oblique edge of the flange 30.

On the other hand, the earth-side element 20 is constituted by at least one second horizontal line 21 extending from the earth-side feeding point 4 in the horizontal direction away from the vertical edge of the flange 30, at least one second vertical line 22 extending from the earth-side feeding point 4 in a direction away from the hot-side feeding point 3 and along the flange 30, and a third horizontal line 23 extending from each tip portion of the second vertical line 22 in the horizontal direction away from the vertical or vertically-oblique edge of the flange 30. In a case that the second horizontal line 21 extending from the earth-side feeding point 4 for the earth-side element 20 in the horizontal direction is changed in length, a resonant frequency can be adjusted.

The number of the second horizontal lines 21 extending from the earth-side feeding point 4 in the horizontal direction is not limited to one but may be two or more. In the same manner, the number of the second vertical lines 22 extending from the earth-side feeding point 4 in the vertical direction is not limited to one but may be two or more. Moreover, the number of the first horizontal lines 11 extending from the hot-side feeding point 3 in the horizontal direction is not limited to one but may be two or more. In the same manner, the number of the first vertical lines 12 extending from the hot-side feeding point 3 in the vertical direction is not limited to one but may be two or more.

Figure 7:
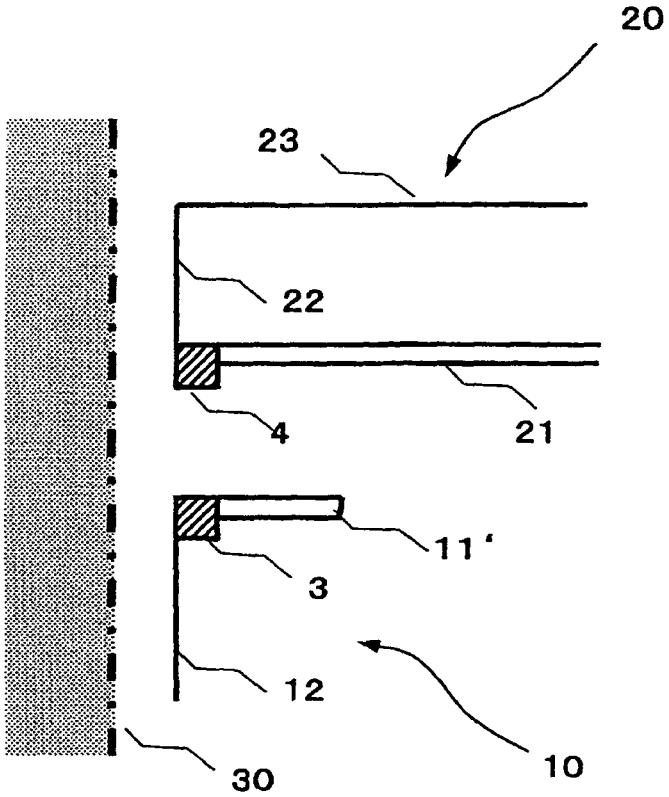
FIG. 7 A view showing a seventh example of glass antenna according to the present invention.

The basic form of each of the first horizontal line 11 and the first vertical line 12 of the hot-side element 10 has been described as a straight-line shape. However, as shown in FIG. 7, any one or both of the first horizontal line 11 and the first vertical line 12 may be formed as a rectangular closed-loop line.

Figure 5:
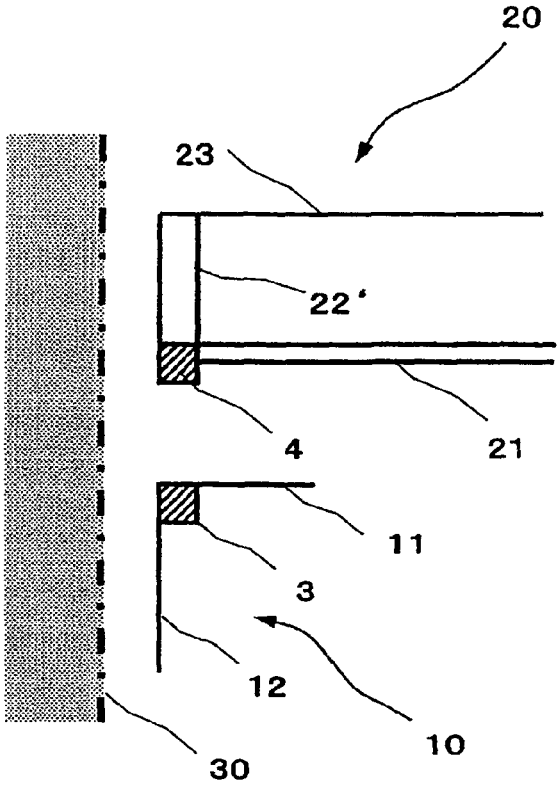
FIG. 5 A view showing a fifth example of glass antenna according to the present invention.
Figure 6:
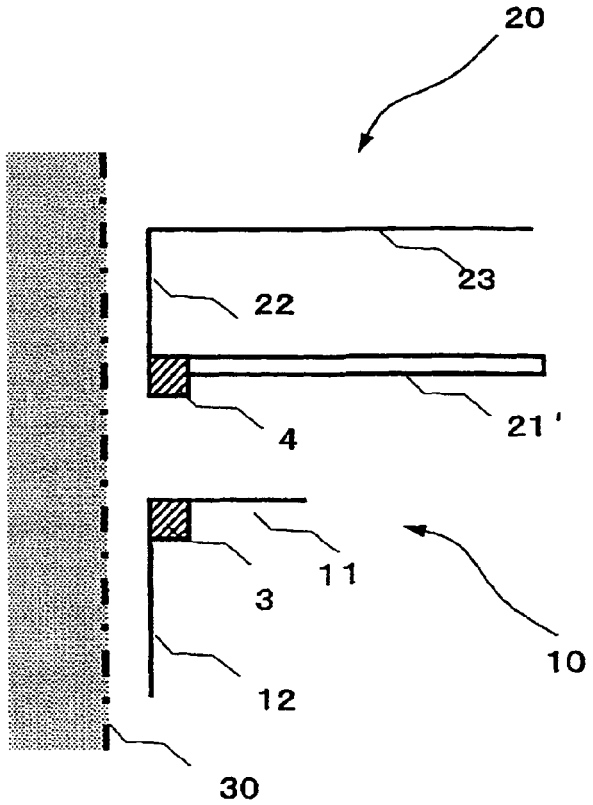
FIG. 6 A view showing a sixth example of glass antenna according to the present invention.

Also, the basic form of each of the second horizontal line 21 and the second vertical line 22 of the earth-side element 20 has been described as a straight-line shape. However, as shown in FIGS. 5 and 6, any one or both of the second horizontal line 21 and the second vertical line 22 may be formed as a rectangular closed-loop line 21', 22'.

Each line extended from the hot-side feeding point 3 or the earth-side feeding point 4 in the horizontal direction or in the vertical direction may be connected with any of an end portion or a middle portion of an edge (i.e., one of four sides) of the corresponding rectangular feeding point 3 or 4.

Figure 8:
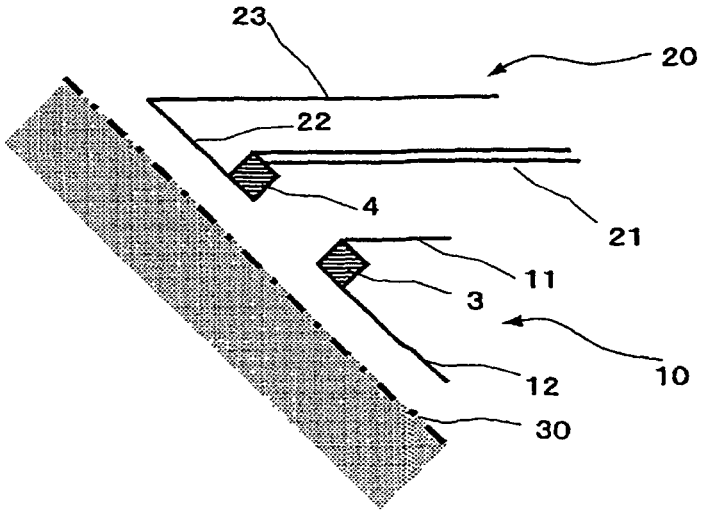
FIG. 8 A view showing an eighth example of glass antenna according to the present invention.
Figure 9:
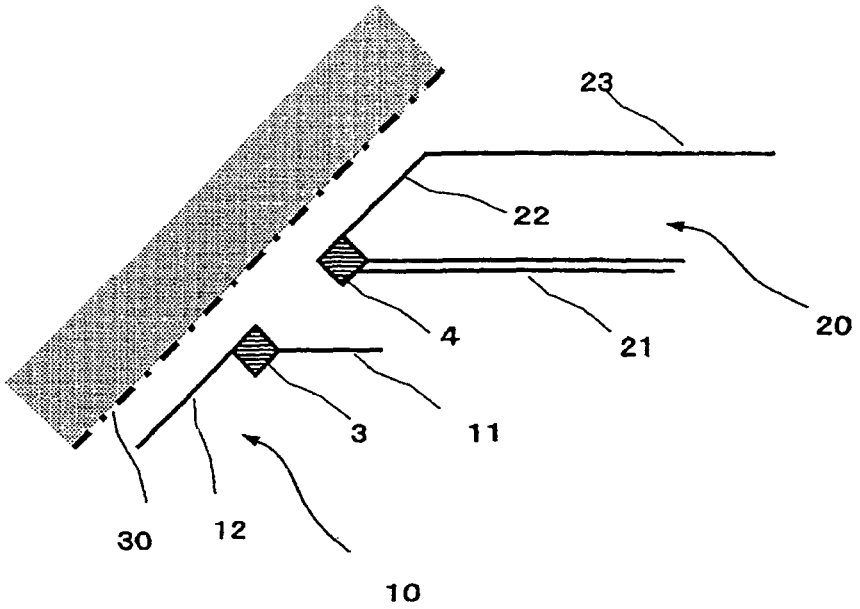
FIG. 9 A view showing a ninth example of glass antenna according to the present invention.

It is noted that the above-mentioned line which extends from the hot-side feeding point 3 or the earth-side feeding point 4 in the vertical direction also means a line extending approximately parallel to an inside vertically-obliquely-extending edge of an opening portion of the flange frame of the fixed window, as shown in FIGS. 1, 8 and 9.

Figure 15:
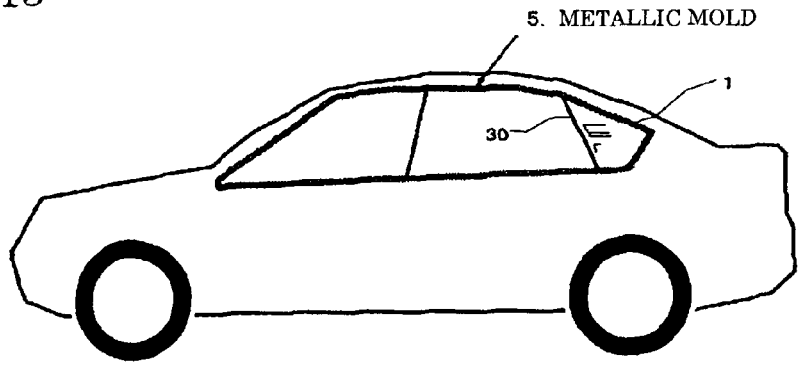
FIG. 15 An overall view of the vehicle in which the glass antenna according to the present invention has been applied to a non-opening fixed window glass located in a rear-seat-side portion of a side portion of the vehicle.

In a case that a metallic mold 5 is attached to the fixed window glass 1 to cover an end edge portion of the fixed window glass 1 as shown in FIGS. 1 and 15, it is preferable that an edge of the fixed window glass 1 to which the metallic mold 5 is not attached is used as the above-mentioned vertical edge of the fixed window glass 1 near which the two of the hot-side feeding point 3 and the earth-side feeding point 4 are provided, in view of prevention of an adverse effect due to the metallic mold. The metallic mold 5 causes the adverse effect, because the metallic mold 5 is ungrounded and thereby in an insulated (floating) state so that the metallic mold 5 operates like some kind of antenna.

As shown in the example of FIG. 15, generally, the metallic mold 5 is provided so as to surround whole of the side window constituted by a window for front-seat door, a window for rear-seat door and the rear-seat-side non-opening window. Hence, the metallic mold 5 formed of a stainless steel or the like is attached in contact to the non-opening window located at a rearmost portion of whole the side window so that the metallic mold 5 covers two edges of an oblique upper edge and an oblique lower edge of the non-opening window. Only the vertical edge of the non-opening window glass (which is located at a frontward portion of the non-opening window glass) is not covered by the metallic mold 5.

Figure 10:
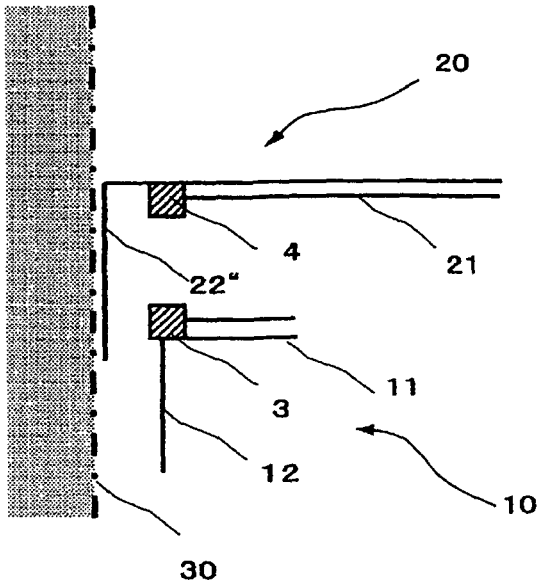
FIG. 10 A view showing a tenth example of glass antenna according to the present invention.

As shown in FIG. 10, the earth-side element 20 may be constituted by a lead line extended from the earth-side feeding point 4 in the horizontal direction to a location near the vertical edge of the flange 30, and a third vertical line 22" extended from a tip of the lead line along the vertical edge of the flange 30, instead of the third horizontal line 23 and the second vertical line 22 extended from the earth-side feeding point 4. There is a space (clearance) between the third vertical line 22" and the vertical edge of the flange 30 in a direction that may be a plate-thickness direction.

The above-mentioned sentence "There is a space in a direction that may be a plate-thickness direction" means at least one of a case where the third vertical line 22" is disposed away from the flange 30 in the plate-thickness direction and a case where the third vertical line 22" is disposed away from a (opening) line of the flange 30 on the same plane of glass-plate surface.

In a case that a diversity reception is performed by using two antenna systems assuming that each of the two antenna systems is a pair of the hot-side element 10 and the earth-side element 20; it is preferable that one antenna system is provided to the non-opening window glass (fixed window glass) located on a right-door side of the vehicle and another antenna system is provided to the non-opening window glass (fixed window glass) located on a left-door side of the vehicle.

Moreover, in a case that a diversity reception is performed by using four antenna systems; in addition to the above-mentioned two antenna systems provided to the right and left side windows of the vehicle, additional two antenna systems according to the present invention or some other two antenna systems are provided to a front window glass of the vehicle or a rear window glass of the vehicle. Alternatively, one of the additional two antenna systems may be provided to the front window glass, and another of the additional two antenna systems may be provided to rear window glass.

The antenna according to the present invention is provided to the non-opening window glass (fixed window glass) of the side window of the vehicle. That is, the antenna according to the present invention may be provided to any of a non-opening window glass (fixed window glass) of the side window which is located on a rearmost-seat side and a non-opening window glass (fixed window glass) of the side window which is located on a foremost-seat side, except a non-opening window provided at a part of an openable/closable door.

According to the present invention, it is preferable that the second horizontal line 21 of the earth-side element 20 of the antenna is kept away by at least 20 mm from an inside upper edge of the flange frame 30 of the window. This is because a received radio wave leaks to the body flange 30 if the antenna according to the present invention is very close to the body flange 30 so that a reception gain is reduced. The above-mentioned distance between the second horizontal line 21 and the flange frame 30 is set in order to prevent such a radiowave leakage.

Moreover, in the case that the metallic mold 5 is attached to the peripheral portion of the fixed window glass; the earth-side feeding point 4 and the hot-side feeding point 3 are provided along the vertical edge of the fixed window glass which is closer to a driver's seat and to which the metallic mold 5 is not attached, as shown in FIGS. 1 and 15.

When the respective feeding points 3 and 4 are provided along the vertical edge of the fixed window glass (non-opening window glass) of the side portion of the vehicle, it is preferable from a standpoint of appearance that these feeding points 3 and 4 are formed to overlap with a black border (not shown) of ceramic paste which is usually provided widely along the peripheral portion of the glass plate.

Operations and effects according to the present invention will now be explained. It is preferable that the first element 10 and the second element 20 constituting the antenna according to the present invention are disposed away by 10 mm or more from edge of the inside opening of the flange frame 30 of the non-opening window of the side portion of vehicle, in order to prevent the first element 10 and the second element 20 from being influenced by metallic body. However, it is not preferable from the standpoint of appearance that the antenna and its feeding points are disposed too far away from the flange frame 30 in an inner direction of the flange frame 30. This is because wiring of the coaxial cable is noticeable.

Moreover, as shown in FIG. 1, the earth-side element 20 is arranged in an upper region of the hot-side element 10, on the non-opening window glass. This is because the case that the earth-side element 20 is arranged in the upper region of the hot-side element 10 can keep the hot-side element 10 further away from the upper edge of the opening portion of the flange 30 than a case that the hot-side element 10 is arranged in an upper region of the earth-side element 20. In the case that the earth-side element 20 is arranged in the upper region of the hot-side element 10, harmful influence which is received by the hot-side element 10 from the flange 30 can be reduced so that a reception performance is enhanced.

Moreover, in the case that the metallic mold 5 is attached to the periphery of the non-opening-window glass plate 1, the hot-side element 10 and the earth-side element 20 according to the present invention are extended respectively from the two feeding points 3 and 4 that are provided near and along the vertical edge of the opening portion of the flange 30 to which the metallic mold 5 is not attached. This is because the metallic mold 5 is generally in an insulated (floating) state, i.e., is not electrically connected to the vehicle body, so that the metallic mold 5 functions like some kind of antenna to adversely affect the antenna according to the present invention.

By varying the length of the second horizontal line 21 extended horizontally from the earth-side feeding point 4 of the earth-side element 20, the resonant frequency can be adjusted.

Examples according to the present invention will now be explained.

First Example

FIG. 1 is a view showing a basic form according to the present invention. In this basic form, the earth-side feeding point 4 and the hot-side feeding point 3 are provided to a vertical edge portion of the rear-seat-side non-opening window of the side portion of the vehicle which is so-called "rear quarter". That is, these two of the earth-side feeding point 4 and the hot-side feeding point 3 are placed near an intermediate portion (near the substantially center) of the vertical edge of the window glass plate 1, in this order from the upper side of the window glass plate 1 so that these two feeding points are vertically close to each other (with respect to gravity direction). The earth-side feeding point 4 is connected with the earth-side element 20. The hot-side feeding point 3 is connected with the hot-side element 10.

This glass antenna is an ungrounded-type antenna including the hot-side feeding point 3, the earth-side feeding point 4, the hot-side element 10 and the earth-side element 20. The hot-side element 10 includes a horizontal line (i.e., linear conductor) and a vertical line which are extended from the hot-side feeding point 3. The earth-side element 20 includes a horizontal line and a vertical line which are extended from the earth-side feeding point 4. The two power-feeding points of the hot-side feeding point 3 and the earth-side feeding point 4 are provided near a center portion of an inside obliquely-vertical edge of the flange of the side window glass. The hot-side feeding point 3 and the earth-side feeding point 4 have a positional relation substantially in upper and lower directions with each other. The hot-side feeding point 3 is connected to the core conductor 2*a* of the coaxial cable 2, and the earth-side feeding point 4 is connected to the enveloping conductor wire 2*b* of the coaxial cable 2.

The hot-side element 10 includes one first horizontal line 11 (length: 35 mm) extending from the hot-side feeding point 3 in the horizontal direction departing from the vertical edge of the flange 30, and one first vertical line 12 (length: 55 mm) extending from the hot-side feeding point 3 in a lower direction departing from the earth-side feeding point 4 along the obliquely vertical edge of the flange 30.

On the other hand, the earth-side element 20 includes two second horizontal lines 21, 21 (each length: 110 mm) extending from the earth-side feeding point 4 in the horizontal direction departing from the obliquely vertical edge (i.e., edge extending in the obliquely vertical direction) of the flange 30, one second vertical line 22 (length: 40 mm) extending from the earth-side feeding point 4 in a direction departing from the hot-side feeding point 3 and along the flange 30, and the third horizontal line 23 (length: 120 mm) extending from the tip portion of the second vertical line 22 in the horizontal direction departing from the oblique edge of the flange 30.

Moreover, each of the hot-side feeding point 3 and the earth-side feeding point 4 is formed in a square shape. Each of width and height (horizontal and vertical lengths) of each of the hot-side feeding point 3 and the earth-side feeding point 4 is equal to 12 mm. A distance between the obliquely vertical edge of the flange 30 and each of the hot-side feeding point 3 and the earth-side feeding point 4 is equal to 30 mm.

Moreover, the core conductor 2*a* of the coaxial cable 2 introduced from a tuner (not shown) is connected with the hot-side feeding point 3, and the enveloping conductor 2*b* of the coaxial cable 2 is connected with the earth-side feeding point 4.

The antenna was formed as follows. An electrically-conductive ceramic paste is printed on a predetermined location of the vehicle-interior side of the window glass plate to cause the width of each line 11, 12, 21-23 to become equal to 0.7 mm. Then, the ceramic paste printed on the window glass plate is dried and burnt in a heating-and-bending furnace.

Figure 13:
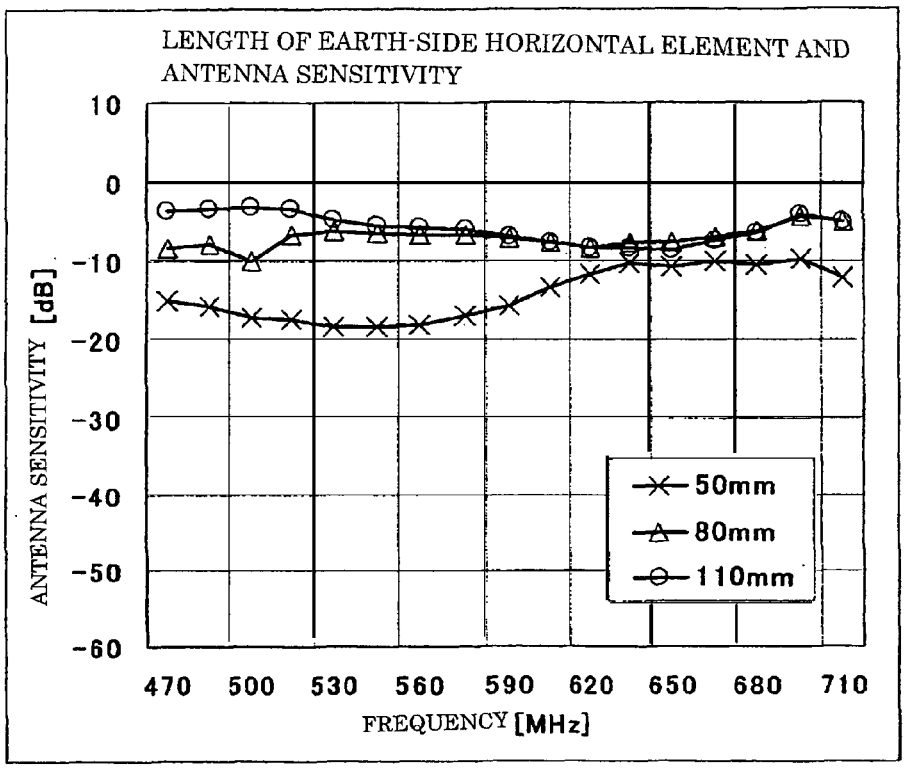
FIG. 13 A frequency characteristic view of the antenna with a variation in length of a horizontal line of an earth-side element, in the first example according to the present invention.

The antenna according to this first example is provided as an antenna for the broadcast wave for digital terrestrial television that has the frequency range from 470 MHz to 710 MHz. From signs ○ in a frequency-characteristic view of FIG. 13, it can be found that the antenna in this example has an excellent receiving characteristic.

The length of each of the two second horizontal lines 21, 21 of the earth-side element was changed to take values of 110 mm (signs ○), 80 mm (signs Δ) and 50 mm (signs X). As a result, in the case that the lengths of the second horizontal lines 21, 21 are equal to 110 mm, the antenna in the first example indicated a frequency characteristic shown by the signs ○ in which a resonance point was obtained over a frequency range from 470 MHz to 530 MHz.

Moreover, in the case that the lengths of the second horizontal lines 21, 21 are equal to 80 mm, the antenna in the first example indicated a frequency characteristic shown by the signs Δ in which the resonance point was obtained over a frequency range from 530 MHz to 590 MHz. Moreover, in the case that the lengths of the second horizontal lines 21, 21 are equal to 50 mm, the antenna in the first example indicated a frequency characteristic shown by the signs X in which the resonance point was obtained over a frequency range from 650 MHz to 680 MHz.

From the above results, it is found that the resonant frequency can be adjusted by varying the length of each of the second horizontal lines 21, 21 which extend from the earth-side feeding point of the earth-side element in the horizontal direction.

Figure 14:
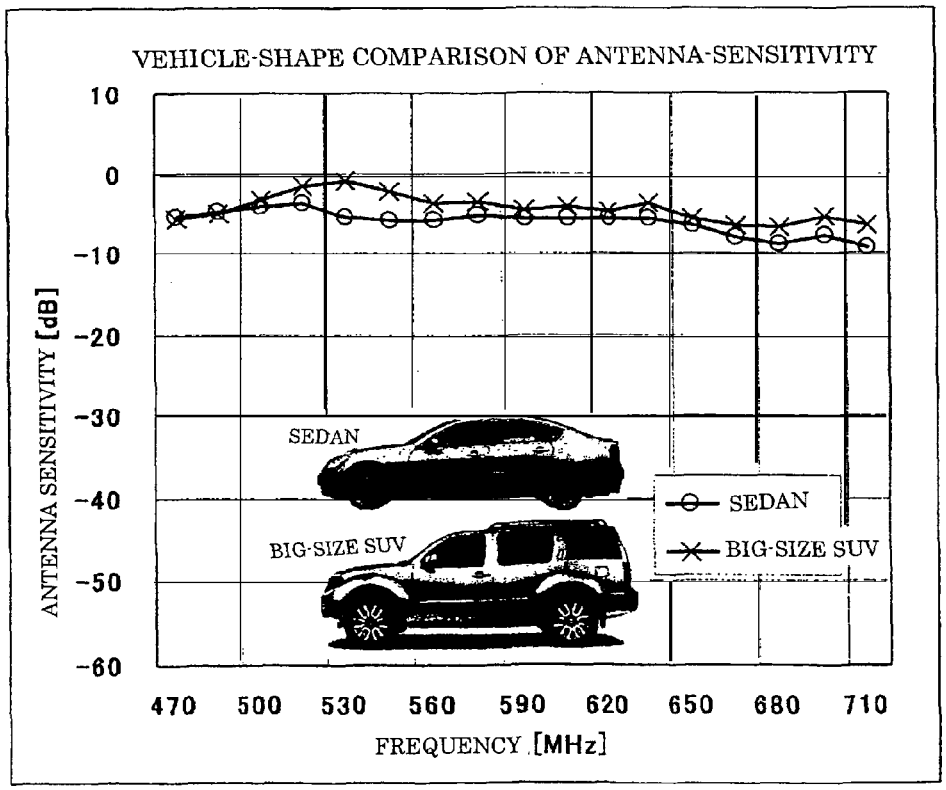
FIG. 14 A frequency characteristic view with respect to a vehicle type, in an antenna pattern of the first example according to the present invention.

The antenna pattern according to the first example was actually provided to the non-opening window (fixed window) of the side window of each of a plurality of sedan vehicles and a plurality of big-size sport-utility vehicles (SUV). Then, a receiving sensitivity of the antenna of each vehicle was measured in the frequency band of the broadcast wave for digital terrestrial television that ranges from 470 MHz to 710 MHz. As a result, the frequency characteristics as shown by FIG. 14 were obtained. Accordingly, it was found that the antenna according to the first example does not have a large difference in frequency characteristic between in the sedan vehicle and in the big-size sport-utility vehicle.

Second Example

Figure 2:
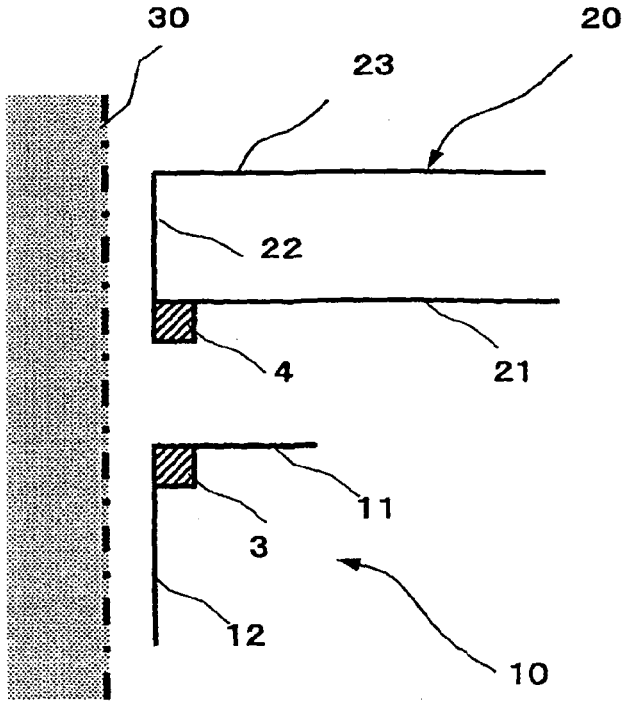
FIG. 2 A view showing a second example of glass antenna according to the present invention.

FIG. 2 is a view showing a modified example of the first example shown in FIG. 1. In this second example, the number of the second horizontal lines 21 extending from the earth-side feeding point 4 of the earth-side element 20 in the horizontal direction is only one. The other structures are same as those of the first example.

The antenna according to the second example was formed as follows. An electrically-conductive ceramic paste is printed on a predetermined location (portion) of the vehicle-interior-side surface of the non-opening window glass plate which is located in the rear-seat side of the side portion of the vehicle that is so-called "rear quarter". Then, the ceramic paste printed on the non-opening window glass plate is dried and burnt in the heating-and-bending furnace. The antenna in the second example was actually provided as an antenna for the broadcast wave for digital terrestrial television that has the frequency range from 470 MHz to 710 MHz. As a result, an excellent receiving characteristic approximately equivalent to that of the first example was obtained.

Third Example

Figure 3:
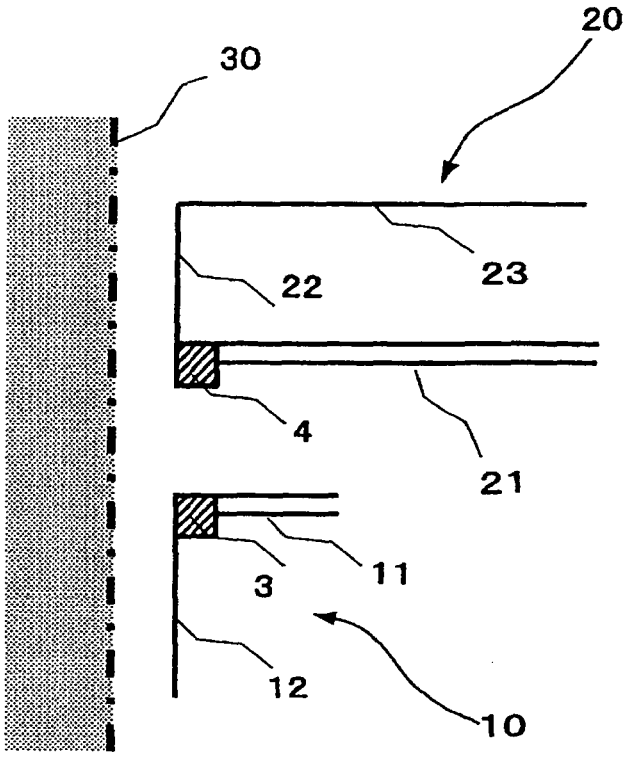
FIG. 3 A view showing a third example of glass antenna according to the present invention.

FIG. 3 is a view showing a modified example of the first example shown in FIG. 1. In this third example, two first horizontal lines 11, 11 extend from the hot-side feeding point 3 for the hot-side element 10 in the horizontal direction. These first horizontal lines 11, 11 extend parallel to each other so that a space between these two parallel lines is kept equal to 6 mm. The other structures are same as those of the first example.

The antenna according to the third example was formed as follows. An electrically-conductive ceramic paste is printed on a predetermined location (portion) of the vehicle-interior-side surface of the non-opening window glass plate which is located in the rear-seat side of the side portion of the vehicle that is so-called "rear quarter". Then, the ceramic paste printed on the non-opening window glass plate is dried and burnt in the heating-and-bending furnace. The antenna in the third example was actually provided as an antenna for the broadcast wave for digital terrestrial television that has the frequency range from 470 MHz to 710 MHz. As a result, an excellent receiving characteristic was obtained in the same manner as the first example.

Fourth Example

Figure 4:
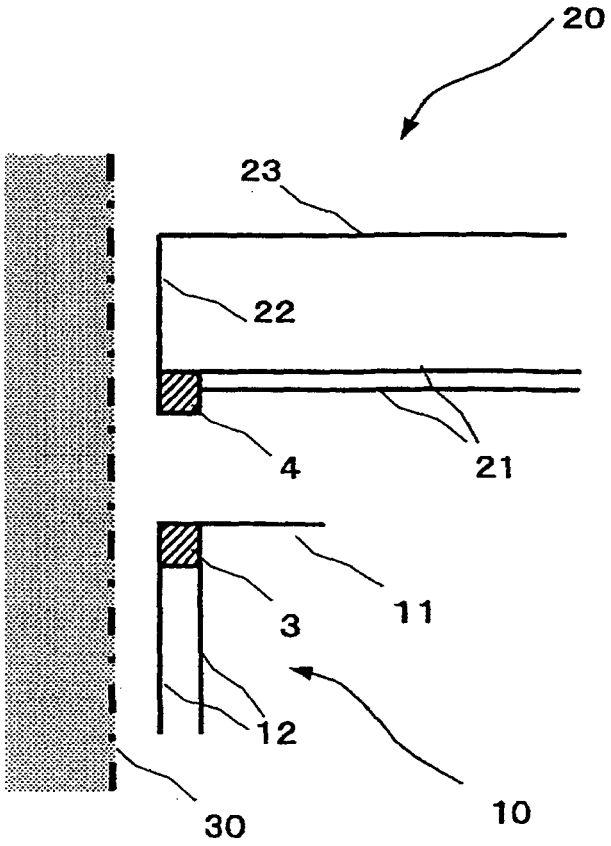
FIG. 4 A view showing a fourth example of glass antenna according to the present invention.

FIG. 4 is a view showing a modified example of the first example shown in FIG. 1. In this fourth example, two first vertical lines 12, 12 extend from the hot-side feeding point 3 for the hot-side element 10 in the vertical direction. These first vertical lines 12, 12 extend parallel to each other so that a space between these two parallel lines is kept equal to 12 mm. The other structures are same as those of the first example.

The antenna according to the fourth example was formed as follows. An electrically-conductive ceramic paste is printed on a predetermined location (portion) of the vehicle-interior-side surface of the non-opening window glass plate which is located in the rear-seat side of the side portion of the vehicle that is so-called "rear quarter". Then, the ceramic paste printed on the non-opening window glass plate is dried and burnt in the heating-and-bending furnace. The antenna in the fourth example was actually provided as an antenna for the broadcast wave for digital terrestrial television that has the frequency range from 470 MHz to 710 MHz. As a result, an excellent receiving characteristic approximately equivalent to that of the first example was obtained.

Fifth Example

FIG. 5 is a view showing a modified example of the first example shown in FIG. 1. In this fifth example, two lines extend from the earth-side feeding point 4 for the earth-side element 20 in the vertical direction. These two lines extend parallel to each other so that a space between these two parallel lines is kept equal to 12 mm. Then, tips of these two lines are connected with each other to form a closed-loop line 22'. The other structures are same as those of the first example.

The antenna according to the fifth example was formed as follows. An electrically-conductive ceramic paste is printed on a predetermined location (portion) of the vehicle-interior-side surface of the non-opening window glass plate which is located in the rear-seat side of the side portion of the vehicle that is so-called "rear quarter". Then, the ceramic paste printed on the non-opening window glass plate is dried and burnt in the heating-and-bending furnace. The antenna in the fifth example was actually provided as an antenna for the broadcast wave for digital terrestrial television that has the frequency range from 470 MHz to 710 MHz. As a result, an excellent receiving characteristic approximately equivalent to that of the first example was obtained.

Sixth Example

FIG. 6 is a view showing a modified example of the first example shown in FIG. 1. In this sixth example, two lines extend from the earth-side feeding point 4 for the earth-side element 20 in the horizontal direction. These two lines extend parallel to each other so that a space between these two parallel lines is kept equal to 6 mm. Then, tips of these two lines are connected with each other to form a closed-loop line 21'. The other structures are same as those of the first example.

The antenna according to the sixth example was formed as follows. An electrically-conductive ceramic paste is printed on a predetermined location (portion) of the vehicle-interior-side surface of the non-opening window glass plate which is located in the rear-seat side of the side portion of the vehicle that is so-called "rear quarter". Then, the ceramic paste printed on the non-opening window glass plate is dried and burnt in the heating-and-bending furnace. The antenna in the sixth example was actually provided as an antenna for the broadcast wave for digital terrestrial television that has the frequency range from 470 MHz to 710 MHz. As a result, an excellent receiving characteristic approximately equivalent to that of the first example was obtained.

Seventh Example

FIG. 7 is a view showing a modified example of the first example shown in FIG. 1. In this seventh example, two horizontal lines extend from the hot-side feeding point 3 for the hot-side element 10 in the horizontal direction. These two lines extend parallel to each other so that a space between these two parallel lines is kept equal to 6 mm. Then, tips of these two lines are connected with each other to form a closed-loop line 11'. The other structures are same as those of the first example.

The antenna according to the seventh example was formed as follows. An electrically-conductive ceramic paste is printed on a predetermined location (portion) of the vehicle-interior-side surface of the non-opening window glass plate which is located in the rear-seat side of the side portion of the vehicle that is so-called "rear quarter". Then, the ceramic paste printed on the non-opening window glass plate is dried and burnt in the heating-and-bending furnace. The antenna in the seventh example was actually provided as an antenna for the broadcast wave for digital terrestrial television that has the frequency range from 470 MHz to 710 MHz. As a result, an excellent receiving characteristic approximately equivalent to that of the first example was obtained.

Eighth Example

FIG. 8 is a view showing a pattern similar to that of the first example shown in FIG. 1. In this eighth example, the vertical edge of the glass plate is greatly inclined. Hence, the first vertical line 12 extends downwardly in a greatly oblique direction along the vertical edge of the glass plate from the hot-side feeding point 3 of the hot-side element 10. Also, the second vertical line 22 extends upwardly in a greatly oblique direction along the vertical edge of the glass plate from the earth-side feeding point 4 of the earth-side element 20. The other structures are same as those of the first example.

The antenna according to the eighth example was formed as follows. An electrically-conductive ceramic paste is printed on a predetermined location (portion) of the vehicle-interior-side surface of the non-opening window glass plate which is located in the rear-seat side of the side portion of the vehicle that is so-called "rear quarter". Then, the ceramic paste printed on the non-opening window glass plate is dried and burnt in the heating-and-bending furnace. The antenna in the eighth example was actually provided as an antenna for the broadcast wave for digital terrestrial television that has the frequency range from 470 MHz to 710 MHz. As a result, an excellent receiving characteristic approximately equivalent to that of the first example was obtained.

Ninth Example

FIG. 9 is a view showing a case having the same pattern as the eighth example shown in FIG. 8. In this ninth example, an inclination direction of the vertical edge of the glass plate is different from that in the eighth example. The other structures are substantially identical with those of the eighth example.

The antenna according to the ninth example was formed as follows. An electrically-conductive ceramic paste is printed on a predetermined location (portion) of the vehicle-interior-side surface of the non-opening window glass plate which is located in the rear-seat side of the side portion of the vehicle that is so-called "rear quarter". Then, the ceramic paste printed on the non-opening window glass plate is dried and burnt in the heating-and-bending furnace. The antenna in the ninth example was actually provided as an antenna for the broadcast wave for digital terrestrial television that has the frequency range from 470 MHz to 710 MHz. As a result, an excellent receiving characteristic approximately equivalent to that of the first example was obtained.

Tenth Example

FIG. 10 is a view showing a modified example of the first example shown in FIG. 1. In this tenth example, instead of the second vertical line and the third horizontal line which are extended from the earth-side feeding point 4 of the earth-side element 20 in the above examples, a lead line extends from the earth-side feeding point 4 in the horizontal direction to a location near the vertical edge of the flange 30. Then, the third vertical line 22" extends vertically along the vertical edge of the opening of the flange 30 from a tip of the lead line. The other structures are same as those of the third example.

The antenna according to the tenth example was formed as follows. An electrically-conductive ceramic paste is printed on a predetermined location (portion) of the vehicle-interior-side surface of the non-opening window glass plate which is located in the rear-seat side of the side portion of the vehicle that is so-called "rear quarter". Then, the ceramic paste printed on the non-opening window glass plate is dried and burnt in the heating-and-bending furnace. The antenna in the tenth example was actually provided as an antenna for the broadcast wave for digital terrestrial television that has the frequency range from 470 MHz to 710 MHz. As a result, an excellent receiving characteristic approximately equivalent to that of the first example was obtained.

Eleventh Example

Figure 11:
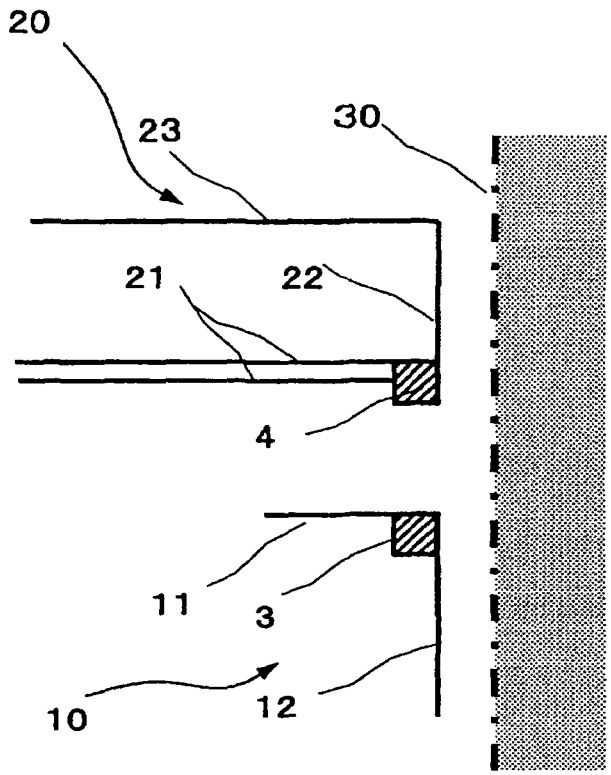
FIG. 11 A view showing an eleventh example of glass antenna according to the present invention.

FIG. 11 is a view showing an example in which the antenna according to the present invention is provided to a predetermined location in the interior-side surface of the non-opening window glass plate which is located in the foremost-seat-side portion of the side window of the vehicle. An antenna pattern in the eleventh example is identical with that of the first example in which the antenna is provided to the non-opening window glass located in the rearmost-seat-side portion of the side window as shown in FIG. 1. In this eleventh example, a location of each feeding point and a direction in which each element extends from the feeding point are different from those of the first example. That is, the earth-side feeding point 4 and the hot-side feeding point 3 are arranged from above in this order along the vertical edge of the rear-seat-side portion of the non-opening window. Lines extending from the earth-side feeding point 4 are defined as the earth-side element 20, and lines extending from the hot-side feeding point 3 are defined as the hot-side element 10.

The antenna according to the eleventh example was formed as follows. An electrically-conductive paste is printed on a predetermined location of the interior-side surface of the non-opening window glass plate which is located in the foremost-seat-side portion of the side window of the vehicle. Then, the paste printed on the non-opening window glass plate is dried and burnt in the heating-and-bending furnace. The antenna in the eleventh example was actually provided as an antenna for the broadcast wave for digital terrestrial television that has the frequency range from 470 MHz to 710 MHz. As a result, an excellent receiving characteristic approximately equivalent to that of the first example was obtained.

Twelfth Example

Figure 12:
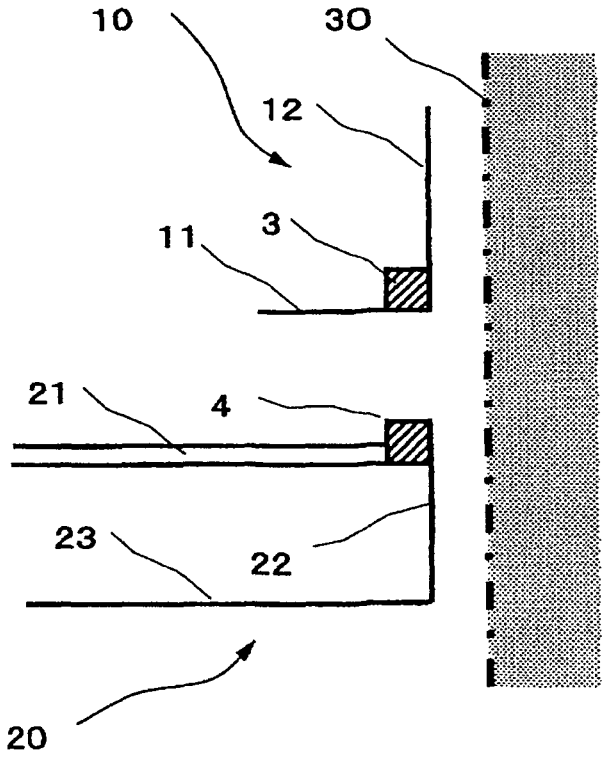
FIG. 12 A view showing a twelfth example of glass antenna according to the present invention.
Figure 16:
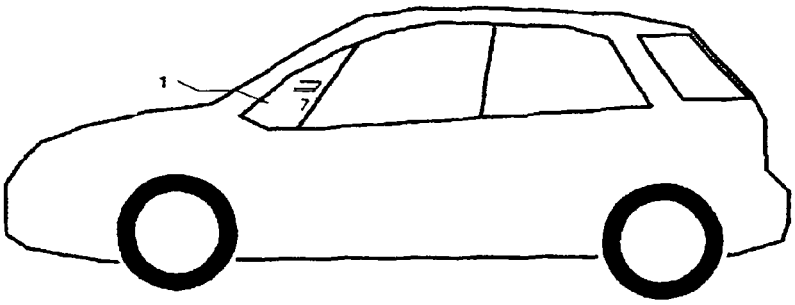
FIG. 16 An overall view of the vehicle in which the glass antenna according to the present invention has been applied to a non-opening fixed window glass located in a front-seat-side portion of a side portion of the vehicle.

FIG. 12 is a view showing an example in which the antenna according to the present invention is provided to a predetermined location of the interior-side surface of the non-opening window glass plate which is located in the foremost-seat-side portion of the side window of the vehicle as shown in FIG. 16, in the same manner as the eleventh example. An antenna pattern in the twelfth example is same as that of the eleventh example in which the antenna is provided to the non-opening window glass located in the foremost-seat-side portion of the side window as shown in FIG. 11. The two feeding points are placed in upper-lower relation along the vertical edge of the rear-seat-side portion of the non-opening window, in the same manner as the eleventh example. However, the hot-side feeding point 3 and the hot-side element 10 take the upper position, and the earth-side feeding point 4 and the earth-side element 20 take the lower position, in an upside-down manner as compared with FIG. 11.

The hot-side feeding point 3 and the earth-side feeding point 4 are arranged from above in this order along the vertical edge of the rear-seat-side portion of the non-opening window. Accordingly, lines extending from the earth-side feeding point are defined as the earth-side element 20, and lines extending from the hot-side feeding point are defined as the hot-side element 10.

The antenna according to the twelfth example was formed as follows. An electrically-conductive paste is printed on a predetermined location of the interior-side surface of the non-opening window glass plate which is located in the foremost-seat-side portion of the side window of the vehicle. Then, the paste printed on the non-opening window glass plate is dried and burnt in the heating-and-bending furnace. The antenna in the twelfth example was actually provided as an antenna for the broadcast wave for digital terrestrial television that has the frequency range from 470 MHz to 710 MHz. As a result, an excellent receiving characteristic substantially equivalent to that of the first example was obtained.

Configurations According to the Present Invention

Some configurations obtainable from the above embodiments and examples will be listed below.

(1) A glass antenna for a vehicle, the antenna being provided to a non-opening fixed window glass of a side portion of the vehicle and being configured to receive a broadcast wave for digital terrestrial television, the antenna comprising: hot-side and earth-side feeding points provided to satisfy a substantially up-down positional relation thereof near an intermediate portion of an inside vertical or vertically-oblique edge of a flange of the window glass; a hot-side element including at least one first horizontal line extending from the hot-side feeding point in a horizontal direction away from the vertical or vertically-oblique edge of the flange, and at least one first vertical line extending from the hot-side feeding point in a direction away from the earth-side feeding point and along the vertical or vertically-oblique edge of the flange; and an earth-side element including at least one second horizontal line extending from the earth-side feeding point in the horizontal direction away from the vertical or vertically-oblique edge of the flange, and a third horizontal line extending from a tip portion of at least one second vertical line in the horizontal direction away from the vertical or vertically-oblique edge of the flange, the at least one second vertical line extending from the earth-side feeding point in a direction away from the hot-side feeding point and along the flange, wherein the antenna is of ungrounded type in which the hot-side and earth-side feeding points are connected respectively to a core conductor and an enveloping conductor of a coaxial cable.

(2) Any one or both of the first horizontal line and the first vertical line of the hot-side element is formed as a rectangular closed-loop line.

(3) Any one or both of the second horizontal line and the second vertical line of the earth-side element is formed as a rectangular closed-loop line.

(4) Each line extending from the hot-side or earth-side feeding point in the horizontal or vertical direction is connected with an end or center of one of four sides of a rectangular shape of the corresponding feeding point.

(5) The vertical or vertically-oblique edge of the fixed window glass to which the hot-side and earth-side feeding points are provided is not covered by a metallic mold.

(6) The earth-side element includes a lead line extending from the earth-side feeding point in the horizontal direction to a location near the vertical or vertically-oblique edge of the flange, and a third vertical line extending from a tip of the lead line along the vertical or vertically-oblique edge of the flange to keep a space between the third vertical line and the vertical or vertically-oblique edge of the flange in a direction that may be a glass-plate-thickness direction, in place of the second vertical line and the third horizontal line extending from the earth-side feeding point.

(7) The non-opening fixed window glass of the side portion of the vehicle is one of a non-opening fixed window glass located in a rearmost-seat-side portion of a side window and a non-opening fixed window glass located in a foremost-seat-side portion of the side window, except a non-opening window provided in a door.

(8) One antenna system including the hot-side element and the earth-side element is provided to the non-opening fixed window glass of a right side portion of the vehicle, and another antenna system including the hot-side element and the earth-side element is provided to the non-opening fixed window glass of a left side portion of the vehicle, so that a diversity reception is performed by using the two antenna systems.

(9) In addition to the two antenna systems provided to the right and left side windows, further two antenna systems each including the hot-side element and the earth-side element or further another-type of two antenna systems are provided to a front window glass of the vehicle or a rear window glass of the vehicle, or are provided respectively to the front window glass and the rear window glass, so that the diversity reception is performed by totally using the four antenna systems.

Advantageous Effects

According to the present invention, the occupied area of the antenna is reduced, and also, the variability of the antenna reception gain is improved, so that the previously-existing problems are solved. That is, even if there is only a limited narrow space like the window glass plate for the vehicle, an ungrounded-type antenna for the broadcast wave for digital terrestrial television can be installed so that a high-sensitive and stable reception performance can be obtained.

Although the invention has been described above with reference to the certain preferable examples (embodiments), the invention is not limited to the examples described above. Various variations of the above examples will occur according to teachings of the present invention.

EXPLANATION OF REFERENCE SIGNS

1 Fixed window glass
2 Coaxial cable
2*a* Core conductor
2*b* Enveloping conductor
3 Hot-side feeding point
4 Earth-side feeding point
10 Hot-side element
11 First horizontal line
11' Closed-loop line
12 First vertical line
20 Earth-side element
21 Second horizontal line
21' Closed-loop line
22 Second vertical line
22' Closed-loop line
23 Third horizontal line
22" Third vertical line
30 Flange

The invention claimed is:

1. A glass antenna for a vehicle, the antenna being provided to a non-opening fixed window glass of a side portion of the vehicle and being configured to receive a broadcast wave for digital terrestrial television, the antenna comprising:

hot-side and earth-side feeding points provided to satisfy a substantially up-down positional relation thereof near an intermediate portion of an inside vertical or vertically-oblique edge of a flange of the window glass;

a hot-side element including at least one first horizontal line extending from the hot-side feeding point in a horizontal direction away from the vertical or vertically-oblique edge of the flange, and at least one first vertical line extending from the hot-side feeding point in a direction away from the earth-side feeding point and along the vertical or vertically-oblique edge of the flange; and an earth-side element including at least one second horizontal line extending from the earth-side feeding point in the horizontal direction away from the vertical or vertically-oblique edge of the flange, and a third horizontal line extending from a tip portion of at least one second vertical line in the horizontal direction away from the vertical or vertically-oblique edge of the flange, the at least one second vertical line extending from the earth-side feeding point in a direction away from the hot-side feeding point and along the flange, wherein the antenna is of ungrounded type in which the hot-side and earth-side feeding points are connected respectively to a core conductor and an enveloping conductor of a coaxial cable.

2. The glass antenna according to claim 1, wherein any one or both of the first horizontal line and the first vertical line of the hot-side element is formed as a rectangular closed-loop line.

3. The glass antenna according to claim 1, wherein any one or both of the second horizontal line and the second vertical line of the earth-side element is formed as a rectangular closed-loop line.

4. The glass antenna according to claim 1, wherein each line extending from the hot-side or earth-side feeding point in the horizontal or vertical direction is connected with an end or center of one of four sides of a rectangular shape of the corresponding feeding point.

5. The glass antenna according to claim 1, wherein the vertical or vertically-oblique edge of the fixed window glass to which the hot-side and earth-side feeding points are provided is not covered by a metallic mold.

6. The glass antenna according to claim 1, wherein the earth-side element includes a lead line extending from the earth-side feeding point in the horizontal direction to a location near the vertical or vertically-oblique edge of the flange, and a third vertical line extending from a tip of the lead line along the vertical or vertically-oblique edge of the flange to keep a space between the third vertical line and the vertical or vertically-oblique edge of the flange in a direction that may be a glass-plate-thickness direction, in place of the second vertical line and the third horizontal line extending from the earth-side feeding point.

7. The glass antenna according to claim 1, wherein the non-opening fixed window glass of the side portion of the vehicle is one of a non-opening fixed window glass located in a rearmost-seat-side portion of a side window and a non-opening fixed window glass located in a foremost-seat-side portion of the side window, except a non-opening window provided in a door.

8. The glass antenna according to claim 1, wherein one antenna system including the hot-side element and the earth-side element is provided to the non-opening fixed window glass of a right side portion of the vehicle, and another antenna system including the hot-side element and the earth-side element is provided to the non-opening fixed window glass of a left side portion of the vehicle, so that a diversity reception is performed by using the two antenna systems.

9. The glass antenna according to claim 8, wherein in addition to the two antenna systems provided to the right and left side windows, further two antenna systems each including the hot-side element and the earth-side element or further another-type of two antenna systems are provided to a front window glass of the vehicle or a rear window glass of the vehicle, or are provided respectively to the front window glass and the rear window glass, so that the diversity reception is performed by totally using the four antenna systems.

* * * * *